US010339533B2

(12) United States Patent
Qian

(10) Patent No.: US 10,339,533 B2
(45) Date of Patent: Jul. 2, 2019

(54) METHODS AND SYSTEMS FOR SCALABLE SESSION EMULATION

(71) Applicant: Spirent Communications, Inc., Sunnyvale, CA (US)

(72) Inventor: Jin J. Qian, Austin, TX (US)

(73) Assignee: Spirent Communications, Inc., San Jose, CA (US)

( * ) Notice: Subject to any disclaimer, the term of this patent is extended or adjusted under 35 U.S.C. 154(b) by 1086 days.

(21) Appl. No.: 13/955,958

(22) Filed: Jul. 31, 2013

(65) Prior Publication Data

US 2015/0039285 A1 Feb. 5, 2015

(51) Int. Cl.
*G06Q 30/00* (2012.01)

(52) U.S. Cl.
CPC ..... *G06Q 30/00* (2013.01)

(58) Field of Classification Search
CPC ..... G06Q 30/00
USPC ..... 703/21
See application file for complete search history.

(56) References Cited

U.S. PATENT DOCUMENTS 5,632,028 A * 5/1997 Thusoo ..... G06F 9/30145 703/26
6,002,871 A 12/1999 Duggan et al.
6,243,832 B1 6/2001 Eckes et al.
6,754,701 B1 6/2004 Kessner
6,810,494 B2 10/2004 Weinberg et al.
6,907,546 B1 6/2005 Haswell et al.
7,406,626 B2 7/2008 Shen et al.
7,793,154 B2 9/2010 Chagoly et al.
7,958,495 B2 6/2011 Kelso
8,392,890 B2 3/2013 Miller
8,429,618 B2 4/2013 Hogan
(Continued)

FOREIGN PATENT DOCUMENTS

WO 01/57671 A1 8/2001

OTHER PUBLICATIONS

Bilenko, D. Gevent: A Coroutine-Based Network Library for Python. Web. www.gevent.org. 2013. Accessed Aug. 5, 2013.
(Continued)

*Primary Examiner* — Rehana Perveen
*Assistant Examiner* — Justin C Mikowski
(74) *Attorney, Agent, or Firm* — Haynes Beffel & Wolfeld LLP; Ernest J. Beffel, Jr.

(57) ABSTRACT

At least some of the illustrative embodiments are methods including: executing a test program on a computer system coupled to a server, the test program emulating virtual users by instantiating a first user instance by calling a first reentrant function, the first user instance exiting the first reentrant function upon encountering a blocking statement in the first reentrant function; instantiating a second user instance by calling the first reentrant function, the second user instance exiting the first reentrant function upon encountering a blocking statement in the first callable function; reentering the first user instance by again calling the first reentrant function, the first reentrant function resuming execution within the reentrant function after the first blocking statement; and reentering the second user instance by calling the first reentrant function, the first reentrant function resuming execution within the reentrant function after the second blocking statement.

33 Claims, 9 Drawing Sheets

(56) References Cited

U.S. PATENT DOCUMENTS

| | | | | |
|---|---|---|---|---|
| 2004/0205174 | A1 | 10/2004 | Snyder et al. | |
| 2005/0071447 | A1 | 3/2005 | Masek et al. | |
| 2009/0037881 | A1 | 2/2009 | Christy et al. | |
| 2009/0199047 | A1 | 8/2009 | Vaitheeswaran et al. | |
| 2013/0182408 | A1* | 7/2013 | Kwon | F21V 9/16 362/84 |

OTHER PUBLICATIONS

Dunkels, A. Protothreads—Lightweight, Stackless Threads in C. Web. dunkels.com/adam/pt/. Accessed Aug. 5, 2013.
Twisted: What is Twisted? Web. twistedmatrix.com/trac/. Accessed Aug. 5, 2013.

* cited by examiner

202

```
1  print "instance started"
2  Connect server_IP server_port
3  increment stats_count_connected
4  Register:
5  send "register from client 1234"
6  wait for response
7  if response is "try again later"
8      sleep 1
9      goto Register
10 else
11     send "login user001 letmein"
12
13     wait for response
14     if response contains "Fail to login"
15         increment stats_failed_logins
16         exit
17
18 loop:
19 #0 is considered uninitialized
20 if temp == 0
21     temp = getTemperature (0)
22     send "base temperature:" +temp
23 else
24     delta = getTemperature(temp) - temp
25     temp -= delta
26     send "temperature change:" + delta
27 wait for response
28 if response contains "stop"
29     exit
30 sleep 10
31 goto loop
```

*FIG. 3*

| 202 | | 210 | |
|---|---|---|---|
| | | clientPseudoThread (instanceMem, event,<br>response){<br>if (instanceMem->returnLabel is defined)<br>goto InstanceMem->returnLabel | 602 |
| 604 print "instance started" | → | print "instance started" | 606 |
| 616 Connect server_IP server_port | → | start_connection_request server_IP server_port<br>instanceMem->returnLabel1 = Label1; return; Label1; | 618 |
| 608 increment stats_count_connected<br>Register:<br>send "register from client 1234" | → | increment stats_count_connected 610<br>Register:<br>send "register from client 1234" | |
| wait for response | → | instanceMem->returnLabel = Label2; return; Label2; | |
| 612 if response is "try again later" | → | if response is "try again later" | 614 |
| sleep 1 | → | startTimer 1<br>instanceMem->returnLabel = Label3; return; Label3; | |
| goto Register<br>else<br>send "login user001 letmein" | → | goto Register<br>else<br>send "login user001 letmein" | |
| wait for response | → | instanceMem->returnLabel = Label4; return; Label4; | |
| If response contains "Fail to login"<br>increment stats_failed_logins<br>exit | → | if response contains "Fail to login"<br>increment stats_failed_logins<br>exit | |
| | → | | |
| loop:<br>#0 is considered unintialized<br>if temp==0<br>650 temp=getTemperature (0)<br>send "base temperature:" +temp<br>else<br>delta=getTemperature(temp)-temp<br>temp-=delta<br>sent "temperature change:" +delta | → | loop:<br>#0 is considered unintialized<br>if instanceMem->temp==0<br>instanceMem->temp = getTemperature(0) 652<br>send "base temperature:"+instanceMem->temp<br>else<br>instanceMem->delta = getTemperature(<br>instanceMem->temp) - instanceMem->temp<br>instanceMem->temp-=instanceMem->delta<br>send "temperature change:" + instanceMem->delta | |
| wait for response | → | instanceMem->returnLabel = Label5; return; Label5; | |
| if response contains "stop"<br>exit | → | if response contains "stop"<br>exit | |
| sleep 10 | → | startTimer 10<br>instanceMem->returnLabel = Label 6; return; Label6; | |
| goto loop | → | goto loop | |
| | → | } | |

*FIG. 6*

METHODS AND SYSTEMS FOR SCALABLE SESSION EMULATION

BACKGROUND

Stress testing and load testing of servers is important for ensuring the servers are capable of handling large numbers of clients concurrently accessing the server. However, as the number of clients that a server is sized to handle grows larger, the resources needed to adequately test the server become unduly cumbersome and expensive. Thus, any advancement which enables streamlined and cost efficient server testing would be beneficial.

BRIEF DESCRIPTION OF THE DRAWINGS

For a detailed description of exemplary embodiments, reference will now be made to the accompanying drawings in which:

FIG. 3 shows an example set of user behaviors within a user input file in accordance with at least some embodiments;

FIG. 6 shows, in table form, a side-by-side comparison of an example set of user behaviors in a user input file and statements in a reentrant function in accordance with at least some embodiments;

NOTATION AND NOMENCLATURE

Figure 1:
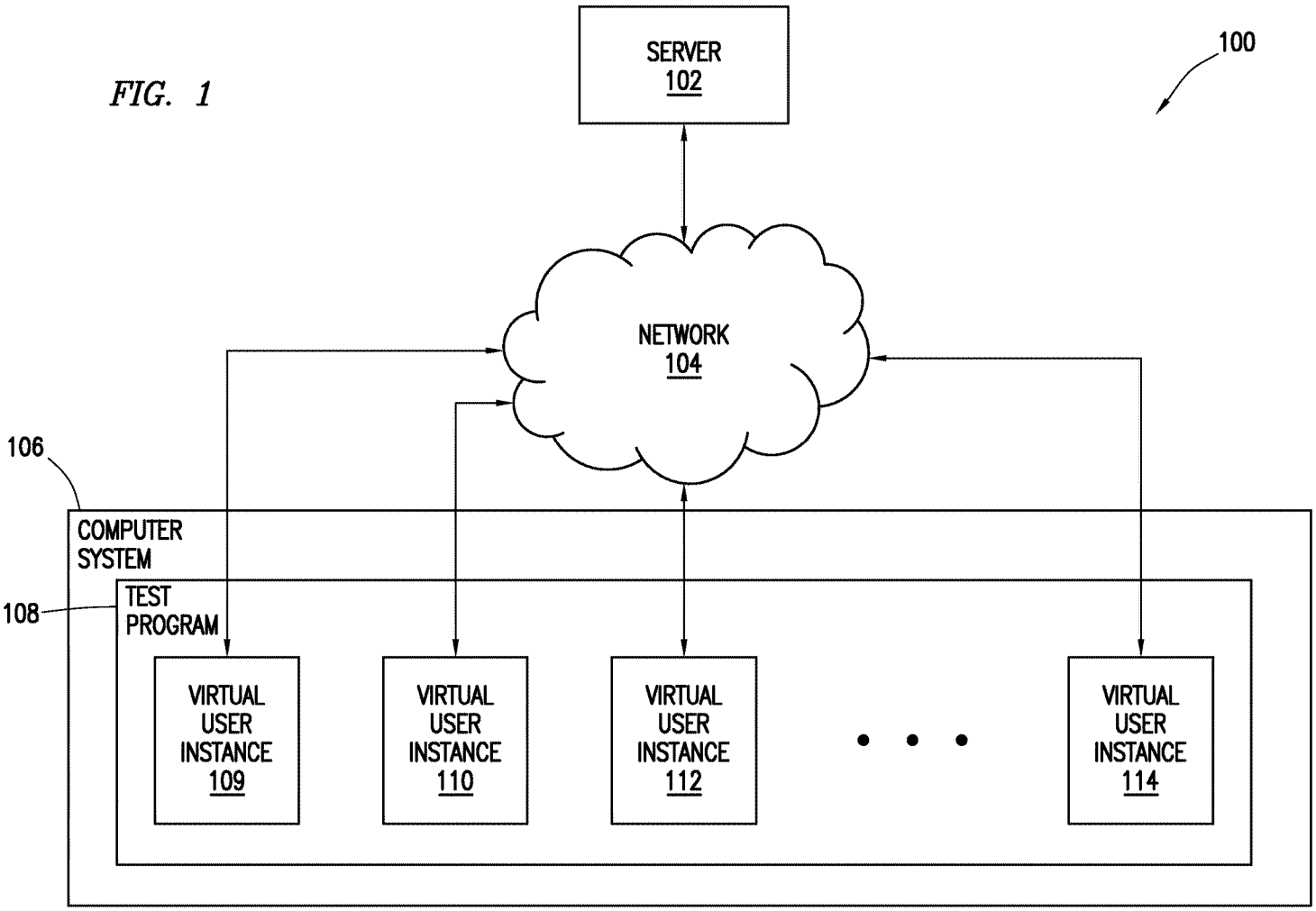
FIG. 1 shows, in block diagram form, a testing system in accordance with at least some embodiments.

Certain terms are used throughout the following description and claims to refer to particular system components. As one skilled in the art will appreciate, different companies may refer to a component and/or method by different names. This document does not intend to distinguish between components and/or methods that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Blocking statement" shall mean a statement residing within a function where the statement, when executed by a first computer system, triggers a response that takes more than 10 clock cycles to receive. The triggered response may come from a different process executing in the same computer system, or the triggered response may come from a second computer system (e.g., a remote server). Such a statement is considered "blocking" because if the function is busy waiting for the response, other statements within the function, and other functions, are blocked from execution during the wait time.

"Reentrant" and "reentrancy", with respect to a function callable by a computer program, shall mean a function is programmed to exit after execution of a blocking statement, and the function (when called again) resumes processing at a point just after the blocking statement.

"Virtual users" shall mean simulated users emulating the actions of a real life user.

"Virtual user instance" shall refer to a single member of the group of virtual users.

"Executable program" shall mean a series of instructions which, when executed by a processor, enables the processor to perform tasks indicated in the file according to encoded instructions.

"Server" shall mean a computer system coupled to the Internet and configured to communicatively interact with remotely located computer systems.

"Thread" shall mean a series of program steps executed as part of a single process (e.g., test program).

"Single thread", in reference to program execution, shall mean that both the main loop of the program and least one reentrant function is executed as part of one and only one thread on the processor.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The various embodiments are directed methods and systems of scalable session emulation. More particularly, the various embodiments are directed to the emulation of a plurality of virtual users interacting with a server undergoing load testing. The specification first turns to a high-level overview.

System Overview

Many businesses and institutions provide services by programs executing on a server. For example, an on-line store may provide retail services to a user when the user connects to the store's server over a network connection. More particularly, a user's interaction with the server may provide a way to register for an account, browse items for sale, instant message with customer service, and buy a product. As another example of services that may be performed by a server, consider a server responsible for collecting weather information from a plurality of remotely located weather monitoring stations. In the weather monitoring context, the "users" are the remote weather monitoring stations that periodically connect to the server and send weather information for storage by the server.

A server, being a computer system, is capable of concurrently communicating with a large number of users, but the number of users and/or the tasks those users attempt to perform may overwhelm the processing power of the server, or may overwhelm the server's communicative coupling to the Internet. If the server does not have sufficient processing power, or has an insufficient bandwidth of connection to the Internet, the response time a user experiences may exceed an acceptable level and/or the server may "time out" (e.g., the connection may terminate). Thus, testing the server's ability to handle a multitude of users accessing a server concurrently is a valuable tool.

Related art server testing programs, however, may be difficult to program and control for someone not highly experienced with computer programming. Moreover, in the related art the number of virtual users a single computer system can simulate may be less than 1000, typically about 500. Thus, related art load testing on a large scale (e.g., 5000 users, 10,000 users) may be slow and/or prohibitively expensive.

FIG. 1 shows, in block diagram form, a testing system in accordance with at least some embodiments. In particular, FIG. 1 shows a server 102 communicatively coupled to a test computer system 106 by way of a network 104. Network 104 may be any of a number of network types. In one embodiment, network 104 may be a local area network (LAN) which interconnects a plurality of computers within a limited geographic area (e.g., an office building or a house). In another embodiment, network 104 may be a wide area network (WAN) including, in part, the Internet.

In order to test the capabilities of the server 102, a test program 108 running on computer system 106 emulates a plurality of virtual users connecting concurrently to server 102 through network 104, and each of the plurality of virtual users interacts with the server 102. In the example of FIG. 1, the test program 108 emulates the connection of four virtual user instances 109, 110, 112, and 114 (hereafter just "user instance" or "user instances") to the server 102. Although four user instances are shown, in practice the number of user instances may be as few as a single user instance, but more likely on the order of thousands of user instances (e.g., 5000 users instances, 10,000 user instances). In some example systems each user instance 109-114 performs the same interaction with the server 102 at slightly different times. In other cases, the user instances may be logically divided into groups, with the user instances within each group performing the same interaction with the server (again, at slightly different times), and each group performing different interactions. Having different interactions among different user instances is discussed more below. For now, consider that each user instance 109-114 performs the same interaction.

Creation of the Test Program

Figure 2:
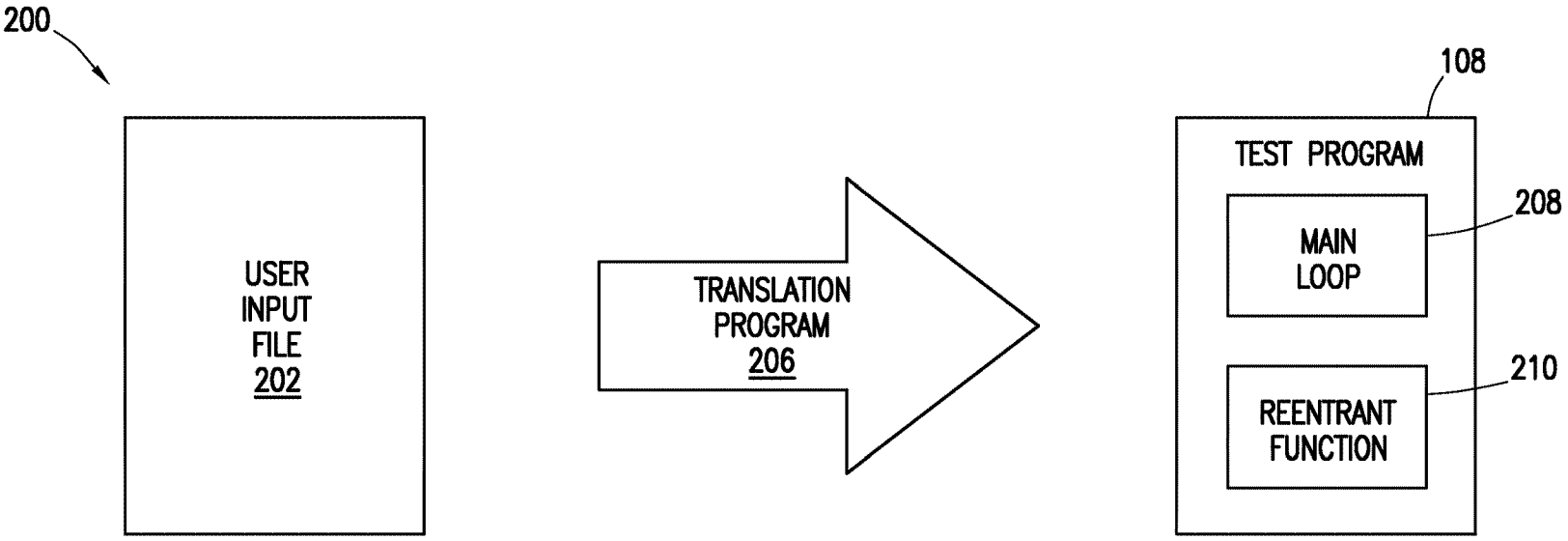
FIG. 2 shows, in block diagram form, conceptual creation of a test program in accordance with at least some embodiments.

FIG. 2 shows, in block diagram form, conceptual creation of the test program 108. The conceptual creation of the test program 108 starts with a input file 202, which input file 202 is applied to a translation program 206. The translation program 206 creates the test program 108, including both the main loop 208 and the reentrant function 210. Each will be discussed in turn, starting with the user input file 202.

User Input File

Before the test program 108 can begin server load testing, a set of user behaviors is created and provided in the form a user input file 202 (hereafter just "input file"). The set of user behaviors defines the desired interaction between a user instance and the server 102. For example, the set of user behaviors in the input file 202 may describe registering for an account on the website for an on-line store. As another example, the set of user behaviors in the input file 202 may describe viewing a series of web pages, and then selecting and ordering a product. As yet another example, the set of user behaviors in the input file 202 may describe sending weather data (e.g., temperature) to the server 102. Any number of user behaviors may be implemented in the input file 202.

In accordance with example systems, the creator of the set of user behaviors in the input file 202 need not have any specialized understanding of the underlying software or the environment in which the set of user behaviors will eventually be executing. In particular, the input file 202 may be written in any suitable file type (e.g., Extensible Markup Language (XML), JavaScript Object Notation (JSON), text), and may contain pseudo code that defines a set of interactions with the server being tested. FIG. 3 shows an example set of user behaviors within the input file 202. In particular, the example pseudo code of FIG. 3 describes the user behavior of connecting to a server (statement at line 2), registering for an account (statements spanning lines 4-16), and sending temperature readings to the server (statements spanning lines 18-31). The pseudo code is merely an example of a possible set of user behaviors, and should not be viewed as a limitation regarding the user behaviors that may be scripted in the input file 202 and ultimately tested.

Translation Program

Referring again to FIG. 2, in order to create the test program 108 the input file 202 is applied to a translation program 206. From the input file 202, and possibly other information (e.g., an indication of a number of user instances to instantiate for a particular server load test), the translation program 206 creates the executable test program 108, with the set of user behaviors defined in the input file 202 becoming executable instructions in a reentrant function 210 which is part of the test program 108. Moreover, as part of the translation process the translation program 206 may create code to enable each user instance to have its own set of local variables. That is, each user instance may have the "same" local variables in a naming sense, but the local variables may be different as between the instances.

Translation of the input file 202 into the test program 108 may comprise multiple steps, not all of which are shown in FIG. 2 so as not to unduly complicate the figure. In particular, translation program 206 may begin by first translating the input file into source code of a commercial programming language. For example, the translation program 206 may translate input file 202 from pseudo code into source code for Lisp, Perl, C, or C++ programming language. Other programming languages, including after-developed programming languages, may be used. From the source code for the programming language, the translation program 206 may then compile user behaviors into the executable reentrant function 210. The translation program 206 may also create an appropriate main loop 208, which main loop 208 is also compiled and included in the test program 108.

Test Program

The end result of the work of the translation program 206 is a test program 108 that comprises both the main loop 208 and at least one reentrant function 210. In accordance with example systems, when executed within the computer system 106 the main loop 208 of the test program 108 instantiates a plurality of virtual users (e.g., user instances 109-114) by repeatedly calling the reentrant function 210. Thus, and referring again to FIG. 1, when the computer system 106 executes the test program 108 created by the translation program 206 (of FIG. 2), the test program 108 instantiates user instances. In the example case of FIG. 1 four user instances may be instantiated, but in practice thousands of user instances may be instantiated. Each example user instance 109-114 interacts with the server 102 according to the set of user behaviors initially defined in the input file 202, and in operation implemented in the reentrant function 210. Understanding how the plurality of user instances can be implemented from a single reentrant function, and how such plurality of user instances can concurrently operate given the single reentrant function, is discussed in greater detail in the following sections.

Concurrently Active User Instances

The discussion of the specification to this point describes a testing system where each user instance implements concurrent and duplicative interaction with the server 102, the interactions initially defined within the input file, and as executed the interactions implemented as executable statements in the reentrant function 210. Before a description of how the concurrent operation takes place, several underlying ideas need to be conveyed to the reader, beginning with a description of blocking statements.

Blocking Statements

Referring again to FIG. 3, several of the example user behaviors shown in FIG. 3 contain statements that, when ultimately implemented, trigger a series of events culminating in a response from the server 102 during testing. Consider, as an example, the statement "Connect server_IP server_port" at line 2 which defines the user behavior of establishing a TCP/IP connection to the server. In order for the test program 108 executing on the computer system 106 to establish the example TCP/IP connection to the server 102, several handshaking messages are exchanged between the computer system 106 and the server 102. These handshaking messages are many times handled transparently to the test program 108, and more particularly are handled by the lower level layers of the Open System Interconnect (OSI) model (e.g., the session layer, transport layer, network layer, data link layer). The point is that the invocation of the lower level layers, and the resultant handshaking messages, used to establish the example TCP/IP connection take a finite amount of time. On human scale time, the finite amount of time is very short (e.g., less than one second); however, on the time scale of operations that a computer system can perform, many hundreds of thousands or millions of operations could take place between the initial request to establish the example TCP/IP connection, and the connection finally being established.

It is possible for a function that requests establishment of the example TCP/IP connection to simply wait for the connection to be established (i.e., spinlock), and then continue executing once the connection is established. However, in the various embodiments the example TCP/IP connection is considered a "blocking statement." That is, if the function that requests establishment of the example TCP/IP connection were to wait for the connection to take place, the waiting "blocks" execution of not only other statements in the function, but also blocks execution of other functions (and separate invocations of the same function). As will be discussed in greater detail below, the various embodiments are implemented such that when the reentrant function 210 encounters a blocking statement, the blocking statement is started, but the reentrant function 210 then exits to enable the reentrant function 210 to be called again with respect to the another user instance while waiting for a response from the server 102. Establishing the TCP/IP connection is merely an example of a blocking statement, and the set of user behaviors of example input file 202 contains several further blocking statements (e.g., the register request statements spanning lines 5-6; the sleep statement on line 8; the registration statements spanning lines 11-16; the sending of the temperature statements spanning lines 26-27; and the sleep statement on line 30).

Memory Area of the Test Program

Figure 4:
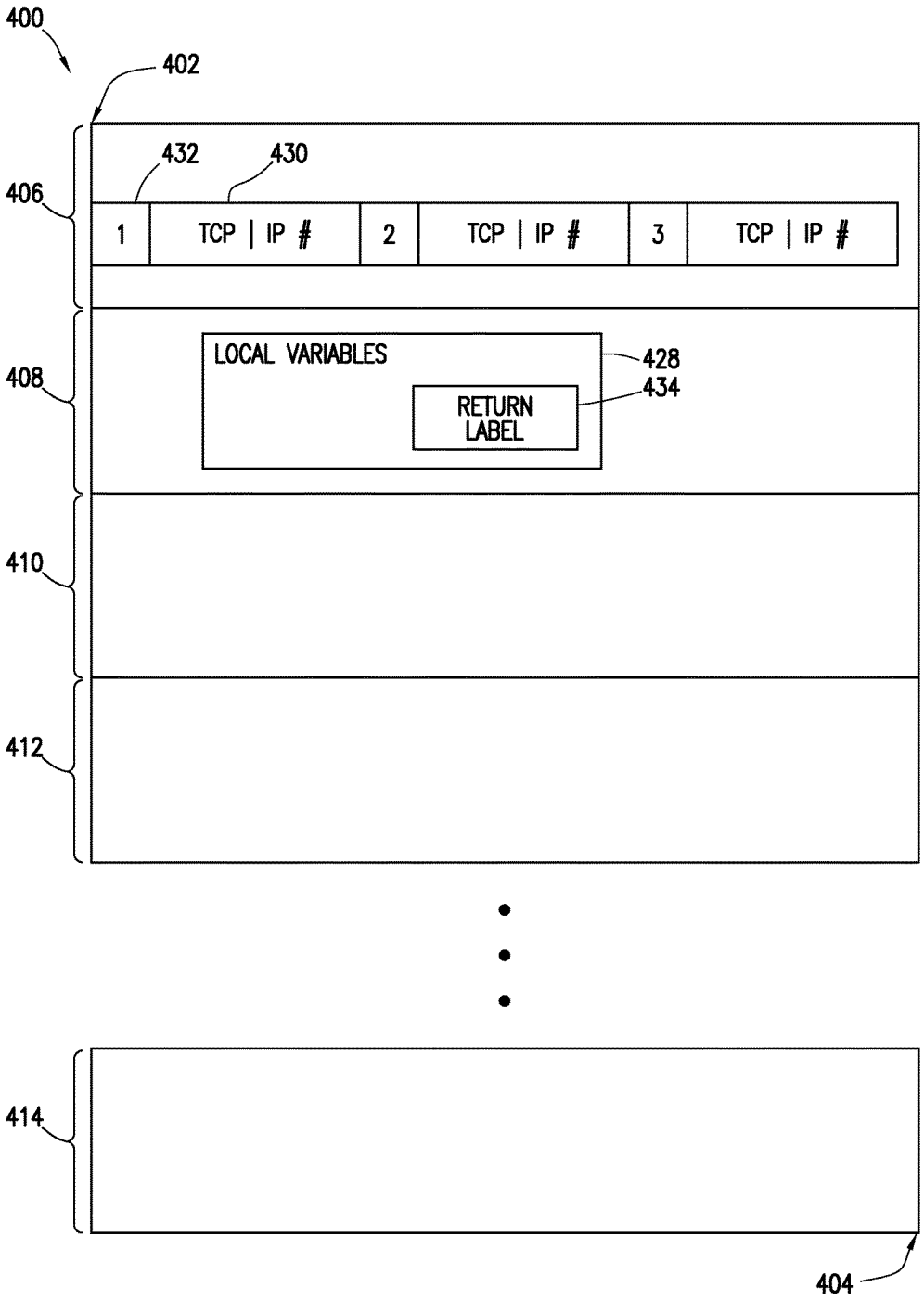
FIG. 4 shows, in block diagram form, a memory area of a test program in accordance with at least some embodiments.

FIG. 4 shows, in block diagram form, a memory area of the test program 108 in accordance with at least some embodiments. In particular, FIG. 4 shows a block of memory starting at an initial memory address 402 and ending at an ending memory address 404. Thus, in some cases the memory area 400 comprises a contiguous set of memory addresses. In other cases, the actual memory area may comprise a non-contiguous set of memory addresses. In yet still other cases, the initial memory address 402 and the ending memory address 404 are virtual addresses, with the computer system on which the test program 108 is executing performing memory translations underlying contiguous or non-contiguous memory addresses to the virtual addresses.

One of the first tasks implemented within the main loop 208 of the test program 108 is allocation of the memory area 400. Any of a variety of memory allocation library functions available may be used to create or allocate the memory area 400 for use. For example, if the translation program 206 creates a C language source code file as part of creating the test program 108, the main loop 208 in source code may contain the C language "malloc( )" or "calloc( )" library functions to allocate the memory area 400. Of course, if a different commercial programming language is used as the language for the source code, memory allocation library functions specific to the commercial programming language would be used.

The memory area 400 is conceptually divided into a plurality of portions. The first portion of interest is the main loop portion 406 which portion is accessible to statements in the main loop 208 as well as to statements in the reentrant function 210. As discussed more below, each user instance may be able to read and write the memory in the main loop portion 406 (and thus may be considered a "global memory"). In the example embodiments the main loop portion 406 is used to identify a user instance associated with a response event (e.g., TCP/IP message received from the server 102 destined for a particular user instance).

Still referring to the FIG. 4, the main loop 208 further conceptually divides the remaining portions of the memory area 400 into designated memory portions for each user instance—each portion referred to as an instance memory. Considering the example system of FIG. 1 containing four user instances 109-114, the remaining memory area is conceptually divided into four portions termed instance memories 408-414, respectively. That is, each user instance created by the test program 108 has a dedicated instance memory within which various labels and local variables are stored. Because the memory area is allocated by the main loop 208, rather than reentrant function 210, the memory area 400 remains allocated and active even though the reentrant function 210 may be called and exit many times over the course of a server load testing procedures. That is, the local variables stored in the instance memories 408-414 for the respective user instances 109-114 are not de-allocated upon exiting of the reentrant function, and thus the local variables are again accessible on second and subsequent calls of the reentrant function 210 from statements in the main loop 208.

Multiple Virtual Users from a Single Reentrant Function

In accordance with example embodiments, each user instance is implemented by repeatedly calling the reentrant function. From a software standpoint, each user instance is created or instantiated by allocation of an instance memory for the user instance, and then calling the reentrant function 210 and passing an indication of the instance memory designated for the user instance. For example, the test program 108 instantiates the user instance 109 by allocating memory area 400 comprising instance memory 408, and then calling the reentrant function 210 including an indication of the location of the instance memory 408. The reentrant function 210, in turn, executes various statements with regard to local variables stored in the instance memory 408 (i.e., implements the user instance 109), and the reentrant function exits which returns control to the main loop 208. The main loop 208 then instantiates the user instance 110 by calling the reentrant function 210 including an indication of the location of the instance memory 410. The reentrant function 210 executes various statements with regard to local variables stored in the instance memory portion 410 (i.e., implements the user instance 110), and the reentrant function 210 exits which returns control to the main loop 208. The process repeats for each user instance implemented by the test program 108 (e.g., 5000 user instances, 10,000 user instances) until each user instance is instantiated. Even after all the user instances have been instantiated (i.e., called the first time), the main loop 208 continues to repeatedly call the reentrant function 210 for each user instance until each user instance performs the complete set of user behaviors. Thus, in the example discussed with respect to FIGS. 1 and 2 of an identical set of user behaviors implemented by each user instance and a single reentrant function 210, the user instances 109-114 are each implemented by repeatedly calling the reentrant function 210 by the main loop 208.

It would be theoretically possible to create the user instances by instantiating and executing through the full set of user behaviors for the user instance 109, and then instantiating and executing through the full set of user behaviors for user instance 110, and so on. However, such a system would not test concurrent interaction of the user instances with the server. In order to create at least partial concurrency, and to account for blocking statements in the set of user behaviors, the reentrant function is designed and constructed to implement a reentrant capability.

Implementing the Reentrant Function

Figure 5:
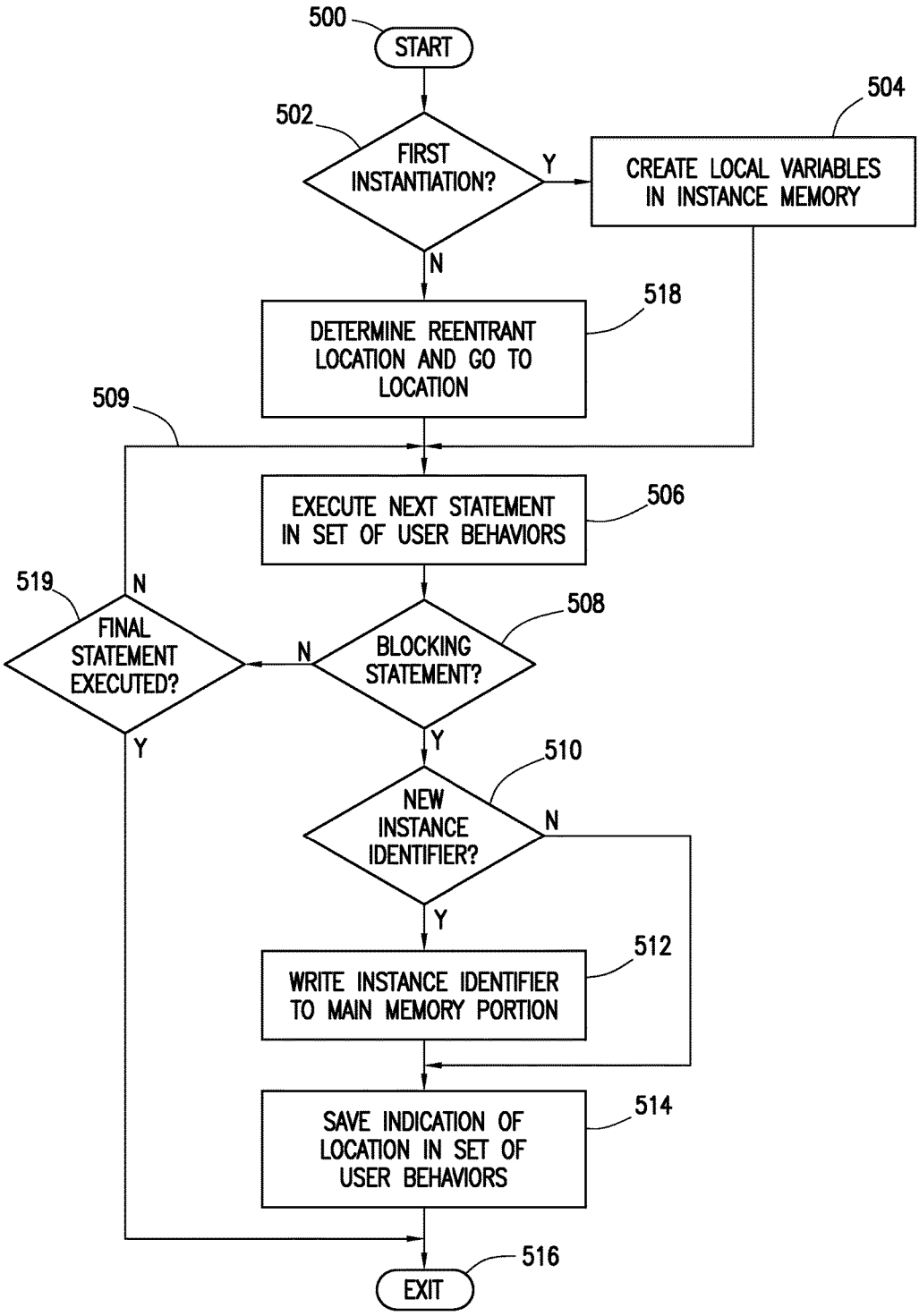
FIG. 5 shows a high level flow diagram of a method to implement reentrant portions of a reentrant function in accordance with at least some embodiments.

Example embodiments implement the at least partial concurrency and likewise deal with the blocking statements by use of function 210 implementing the ability to exit the function 210 upon encountering a blocking statement, and later resume execution after the blocking statement—hence the name reentrant function 210. FIG. 5 shows a high level flow diagram of a method to implement the reentrant portions of the example reentrant function 210. The specification addresses the initial instantiation of the user instance, and then discusses later reentering the user instance.

Initial Instantiation

The example method starts (block 500) by the main loop 208 calling the reentrant function 210 and passing an indication of the location of the instance memory for the user instance. For purposes of discussion of FIG. 5, it will be assumed that the main loop 208 has called the reentrant function 210 in relation to the user instance 109 (and thus instance memory 408); however, the explanation is equally applicable for all the user instances and their respective instance memory portions.

The example reentrant function 210 first makes a determination as to whether the particular execution of the reentrant function 210 by the main loop 208 is the first time the main loop 208 has called the reentrant function 210 with respect to the user instance 109 (block 502)—the initial instantiation. The determination may take many forms. For example, the main loop 208 may pass a parameter indicating the calling of the reentrant function 210 is the initial instantiation. In another case, the main loop 208 may not pass a parameter or pass a null indicating the calling of the reentrant function 210 is the initial instantiation. In other cases, the determination of block 502 may be made by reading the instance memory designated by the main loop 208. For example, if the instance memory 408 has yet to be initialized with the local variables for the reentrant function, such a lack of initialization may be used to make the determination of block 502.

If the particular calling by the main loop 208 is the initial instantiation of the user instance 109, the next step may be creation of the local variables (block 504) in the instance memory 408. That is, the set of user behaviors implemented within the reentrant function 210 may use one more local variables (e.g., counter values, return labels), and in order for the local variables to be available on second and subsequent callings of the reentrant function 210 for the user instance 109, the local variables may be created in the instance memory 408. Turning briefly to FIG. 4, the example program may create the local variables 428 in the instance memory 408 for the user instance 109. In other cases, rather than create the local variables in the instance memory on the initial instantiation, the local variables may be created as needed during execution, including creation during second and subsequent callings of the reentrant function 210 for the particular user instance.

Returning to FIG. 5, the next step in the illustrative method is to execute the next statement in the set of user behaviors defined by the reentrant function (block 506). In the initial instantiation, the "next statement" is the first statement that implements a set of user behaviors. A determination is then made as to whether the statement executed (at block 506) is a blocking statement (block 508). For example, if the statement executed is a statement to increment a local or global variable or to print a comment to a display device, such a statement is not a blocking statement. When the statement is not a blocking statement (as determined at block 508), and ignoring for now the corner case where the statement was the last statement in the set of user behaviors, the example method steps to executing the next statement as shown by the "no" path and line 509. On the other hand, if the statement executed is an example TCP/IP connection request to the server 102, the connection may require a finite amount of time to be created and thus is considered a blocking statement. In the case of a blocking statement, rather than wait for the blocking statement to complete, the reentrant function 210 exits to enable other user instances to be instantiated or reentered.

In order to exit the reentrant function, the example method next makes a determination as to whether the blocking statement creates a new identifier (block 510). If a new identifier is created, the example method writes the identifier to the main memory portion (block 512). On the other hand, if the blocking statement does not create a new identifier (again block 510), then the example method proceeds to saving an indication of the location in the set of local variables at which the next calling of the reentrant function 210 for the user instance 109 should resume execution (block 514), and the method exits (block 516).

With respect to the new identifier, consider again the example TCP/IP connection request. A TCP/IP connection request is not only a blocking statement, but is also associated with a handle that identifies the connection. In order for the main loop 208 to correlate the user instance to a message returned to the main loop (e.g., by the main loop executing a select( ) function call, a libev( ) function call, or a libevent( ) function call) by the operating system regarding the status of the connection (e.g., connection made), prior to exiting the reentrant function 210 writes information in main loop portion 406 of the memory area 400. Returning briefly to FIG. 4, in the example of a TCP/IP connection request, the reentrant function may write the TCP/IP handle (i.e., the identifier 430) along with an indication of user instance to which the handle pertains (i.e., the value 432). Later in time, when the main loop 208 receives a message regarding the example TCP/IP connection request (the message including the handle), the main loop inspects the main loop portion 406 and thereby identifies the user instance 109. In other embodiments, rather than the reentrant function writing the main loop portion 406, the reentrant function may return the handle to the main loop 208 as part of the exit procedure, and the main loop may be responsible for creating the entry which correlates the identifier 430 to the value 432.

Still referring to FIG. 4, and with respect to saving an indication of the location in the set of user behaviors at which to resume execution, in example embodiments the reentrant function 210 may write in the designated instance memory, and particularly in the local variables in the instance memory, a return label value that indicates where within the set of user behaviors the execution should resume when the reentrant function is again called by the main loop. For the example case of the user instance 109 and respective instance memory 408, the reentrant function 210 may write in the return label 434 an indication where execution should resume when the reentrant function 210 is later called with the respect to the user instance 109.

While waiting for the blocking statement to complete, the main loop 208 may instantiate another user instance by again calling the reentrant function 210 and passing an indication of the instance memory for the user instances. For example, while waiting for the blocking statement to complete regarding user instance 109, the main loop may instantiate the user instance 110 by calling the reentrant function 210 and passing an indication of the instance memory portion 410. In fact, many user instances may be instantiated. Moreover, while waiting for the blocking statement to complete for one user instance, the main loop may reenter a different and previously instantiated user instance.

Reenter the User Instance

Returning to FIG. 5, and continuing the example regarding user instance 109, now consider that the main loop 208 reenters the user instance 109. That is, the main loop 208 again calls reentrant function 210 passing an indication of the instance memory 408. If the last exit from the user instance 109 was for a blocking statement that required a response from the server 102, when the server 102 returns the response the main loop 208 may reenter the user instance 109. On the other hand, if the last exit from the user instance 109 was for a blocking statement that did not require a response from the server 102 (e.g., a "sleep 10 seconds" statement), the main loop 208 may reenter on a timer basis. Regardless, when the user instance is reentered, the example method again makes the determination regarding the first instantiation (block 502). The reentering under consideration is not an initial instantiation, and thus the example method proceeds to determining the reentrant location and jumping to the location (block 518). Turning briefly to FIG. 4, as an example the reentrant function 210 may read the return label 434 in the instance memory 408, and then jump to that return label in the set of user behaviors. The example method then proceeds with executing the next statement in the set of user behaviors (block 506), and the method continues as previously discussed.

When the next blocking statement with respect to the user instance 109 is encountered, the user instance exits and the main loop reenters the user instance (e.g., user instances 110) by again calling the reentrant function and passing an indication of the instance memory associated with the user instance.

Final Exit

Still referring to FIG. 5, the last case to consider is the situation where the user instance executes the final statement of the set of user behaviors, and thus exits the reentrant function for the final time. The "final statement" need not necessarily be the last statement in the set of user behaviors. The "final statement" may occur in the middle of the set of user behaviors where a certain condition is met or not met. Returning to decision block 508, if the statement executed was not a blocking statement, there is the possibility that the statement executed was the final statement in the set of user behaviors. Thus, the example method makes a determination as to whether the statement is the final statement (block 519). If true, the example method exits (again block 516). The reentrant function may inform the main loop 208 that the user instance has completed, and the informing may take any suitable form. For example, the reentrant function may return a special value (e.g., a null value) to the main loop 208. Upon receiving control from a reentrant function indicating the user instance has completed, the main loop 208 may terminate/de-allocate the instance memory for the particular user instance.

Returning to decision block 519, if the statement executed was not the final statement, the example method jumps back to execute the next statement in the set of user behaviors (again block 506).

Example Translation and Reentrant Implementation

Now understanding the relationship between the user instances, the memory area, respective instance memories, and how blocking statements can give rise to at least partially concurrent operation of the user instances, the specification turns to an example translation of the input file into reentrant function, including an example set of source code to implement the reentrancy aspects.

FIG. 6 shows, in table form, a side-by-side comparison of the example set of user behaviors in the input file 202 of FIG. 3 (on the left of FIG. 6) and statements in a reentrant function 210 (on the right of FIG. 6, shown as source code in pseudo code format). In particular, the translation program 206 in this example creates a reentrant function illustratively named clientPseudoThread to which is passed a pointer "instanceMem" being a pointer to the instance memory for the user instance. The "event" parameter is not used in the example set of user behaviors, but may be used by the main loop to pass indications of events (e.g., timer expired, connection made). Also passed to the example reentrant function is the parameter "response", which may be a pointer to a memory area containing the response received related to a blocking statement.

In accordance with example embodiments, the translation program 206 creates a program header 602 which at least partially implements the reentrancy. For example, the function header 602 may be represented by:

```
if (instanceMem->returnLabel is defined )
    go to instanceMem->returnLabel
```

In the example embodiment, the statement above tests whether the "returnLabel" parameter in the instanceMem is defined, and if so the example reentrant function, when executed, jumps to the location indicated by the "returnLabel" parameter. An example of the jump to the location indicated is discussed after introducing an example blocking statement below.

The translation program 206 translates by stepping through each statement contained within input file 202, and creating corresponding statements in the reentrant function 210. The first substantive statement in the example of FIG. 6 is the "print 'instance started'" statement 604. The translation program creates a corresponding print statement in the reentrant function 210, namely the "print 'instance started'" statement 606. Because the example print statement can be immediately executed and does not trigger a response or significantly delay execution of later statements, the print statement is not considered a blocking statement (i.e., a non-blocking statement). Other examples of non-blocking statements include the "increment" statement at 608 (and corresponding increment statement 610 in the reentrant function) and the example "if response is" statement 612 (and corresponding "if response is" statement 614 in the reentrant function), where the "response" is the parameter passed to the reentrant function 210 by the main loop 208. Other non-blocking statements are also present, but not expressly noted so as not to unduly lengthen the specification.

Continuing with the example, the translation program 206 may then read the "Connect server_IP server_port" statement 616. The translation program 206 may translate the "connect" statement 616 into the following statements 618 in the reentrant function 210:

```
start__connection__request server__IP server__port
instanceMem–>returnLabel1 = Label1; return; Label1:
```

The statements 618 show an example of a blocking statement as well as how the translation program 206 may code the reentrant functionality. In particular, the "Connect server_IP server_port" statement 616 is an instruction to create a communicative connection to the server 102. The translation program 206 creates a corresponding connection statement "start_connection_request server_IP server_port" in the reentrant function 210. Moreover, the translation program knows the "Connect server_IP server_port" statement 616 is a blocking statement, and so the translation program 206 also includes statements in the reentrant function to implement the reentrancy. In particular, the translation program 206 in this example also includes the statement "instanceMem->returnLabel1=Label1; return; Label1;" which in combination with the header 602 implements the reentrancy with respect to the "start_connection" blocking function.

The translation program 206 continues to parse through the pseudo code of input file 202, reading each statement and translating each statement into one or more statements in the source code version of the reentrant function 210.

With respect to how the statements implement the example reentrancy, consider that during an actual server load test the executable version of the reentrant function executes the "start_connection" statement of statements 618. The "start_connection" statement takes a finite amount of time to complete (e.g., to complete the required handshaking and receive a response from the server). Thus, the executable version of reentrant function 210 sets the "returnLabel1" parameter of the instanceMem to "Label1", and returns or exits to the main loop 208. When the main loop 208 later receives an indication the connection has completed, the main loop calls the reentrant function with the pointer to the instanceMem for the particular user instance. The header 602 determines the "returnLabel1" parameter is not only defined, but has a value (in this example, Label1), and thus the header 602 jumps to the location "Label1" (just after the return call), and continues execution.

Still referring to FIG. 6, the translation program also translates variables defined in the set of user behaviors in the input file 202 into local variables for each user instance. Consider, as an example, the "temp=getTemperature( )" statement 650 in the input file 202. The translation program 206 translates the statement 650 into a corresponding "instanceMem->temp- . . . " statement 652 in the source code of the reentrant function 210. In particular, the translation program 206 creates statements in the source code that (when ultimately executed) create the example local variable in such a way that the local variable is associated only with the instance memory associated with the user instance. The same is true for each local variable in the set of user behaviors. Thus, while different user instances may use the "same" local variables in a name sense, the respective local variables are stored in respective instance memories and thus may have different values.

Virtual User Groups

In one embodiment, the set of user behaviors implemented may be the same for all the user instances, such as the four user instances 109-114. As discussed above, the set of user behaviors may be defined in the input file 202.

Figure 7:
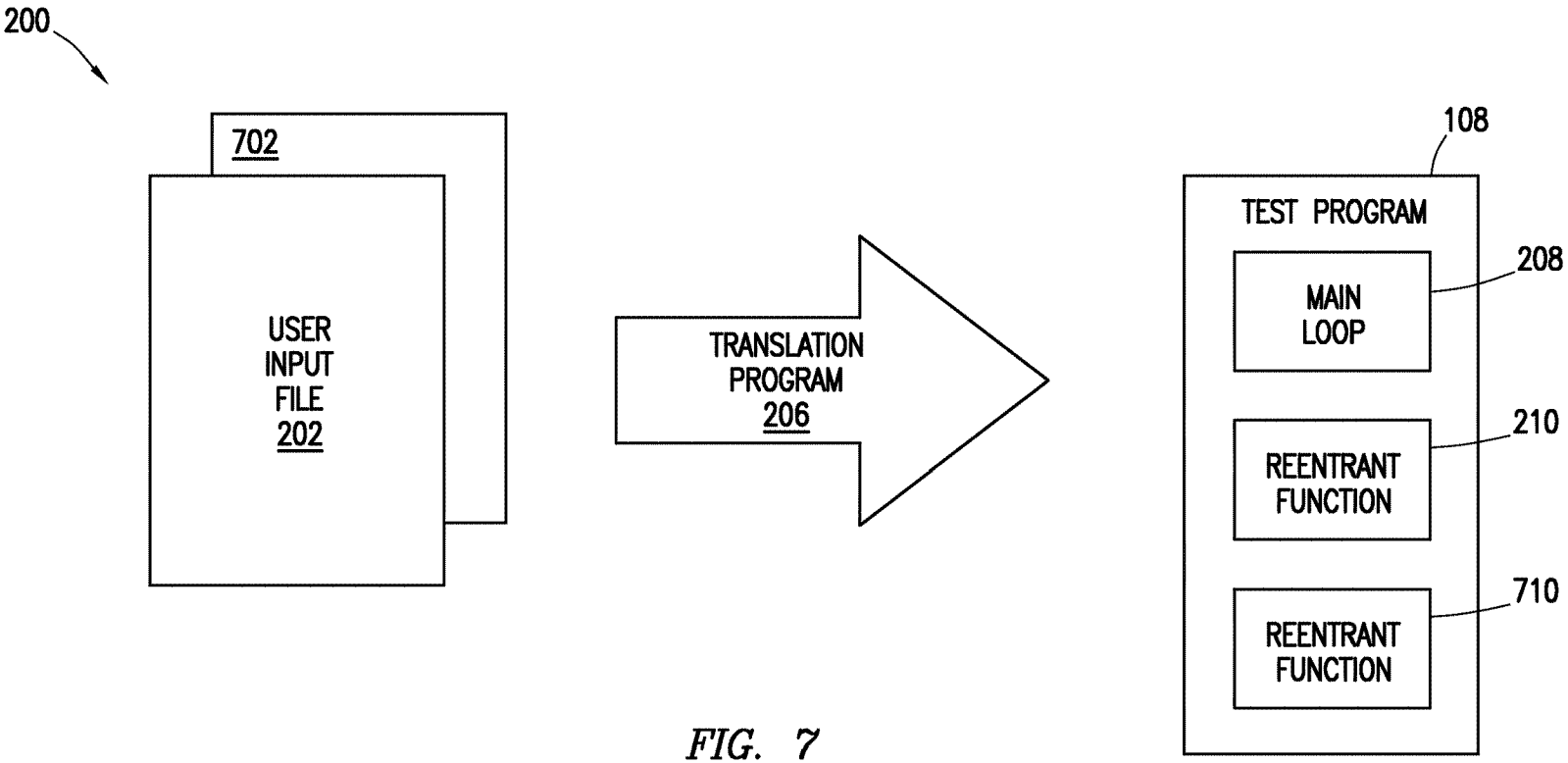
FIG. 7 shows, in block diagram form, an example conceptual creation of a test program based on more than one user input file in accordance with at least some embodiments.

In another embodiment, however, multiple sets of user behaviors may be defined. FIG. 7 shows, in block diagram form, conceptual creation of the test program 108 based on more than one input file. In particular, FIG. 7 shows input file 202, along with input file 702. Each input file contains a set of user behaviors. While there may be duplicate behaviors as between input files 202 and 702, in most cases the sets of user behaviors will differ in at least one respect, and thus will be considered different.

In the case of FIG. 7, the conceptual creation of the test program 108 starts with input file 202 applied to a translation program 206. The translation program 206 creates the reentrant function 210. Likewise, input file 702 is applied to the translation program 206 which creates the reentrant function 710. The main loop 208 may then instantiate a plurality of virtual users, with one group of user instances implementing the set of behaviors of reentrant function 210, and other group of user instances implementing the set of behaviors of reentrant function 710. For example, 75% of the user instances (e.g., three of the four instances) implement the behavior described in input file 202, and 25% of the user instances (e.g. one of the four instances) implement the behavior described in input file 202. The 75/25 relationship is merely an example, and other relationships are possible. In some cases the relation may be hard-coded in the main loop 208, and in other cases the relationship may be a parameter passed to the test program when started, such that the relationship of the number of instances in each group is controllable by the person who starts the test program 108.

Moreover, having two input files is merely an example. In the case of multiple input files, any number of distinct input files may be implemented, resulting in a respective number of reentrant functions. In one example, each and every virtual instance may be associated with its own input file and thus reentrant function, but in other cases groups of user instances will all be associated with an input file and thus reentrant function.

Single Thread

In accordance with at least some embodiments, the test program implements the plurality of user instances within a single processing thread of the computer system 106. That is, "concurrent" operation of each user instance, where the reentrant function exits upon encountering a blocking statement, enables all the user instances, in some cases at least 5000 user instances, and in other cases at least 10,000 user instances, to be executed by way of a single processing thread on the computer system. Such a system can thus implement more user instances on a single computer than systems that attempt to implement each user instance in a respective processing thread.

Figure 8:
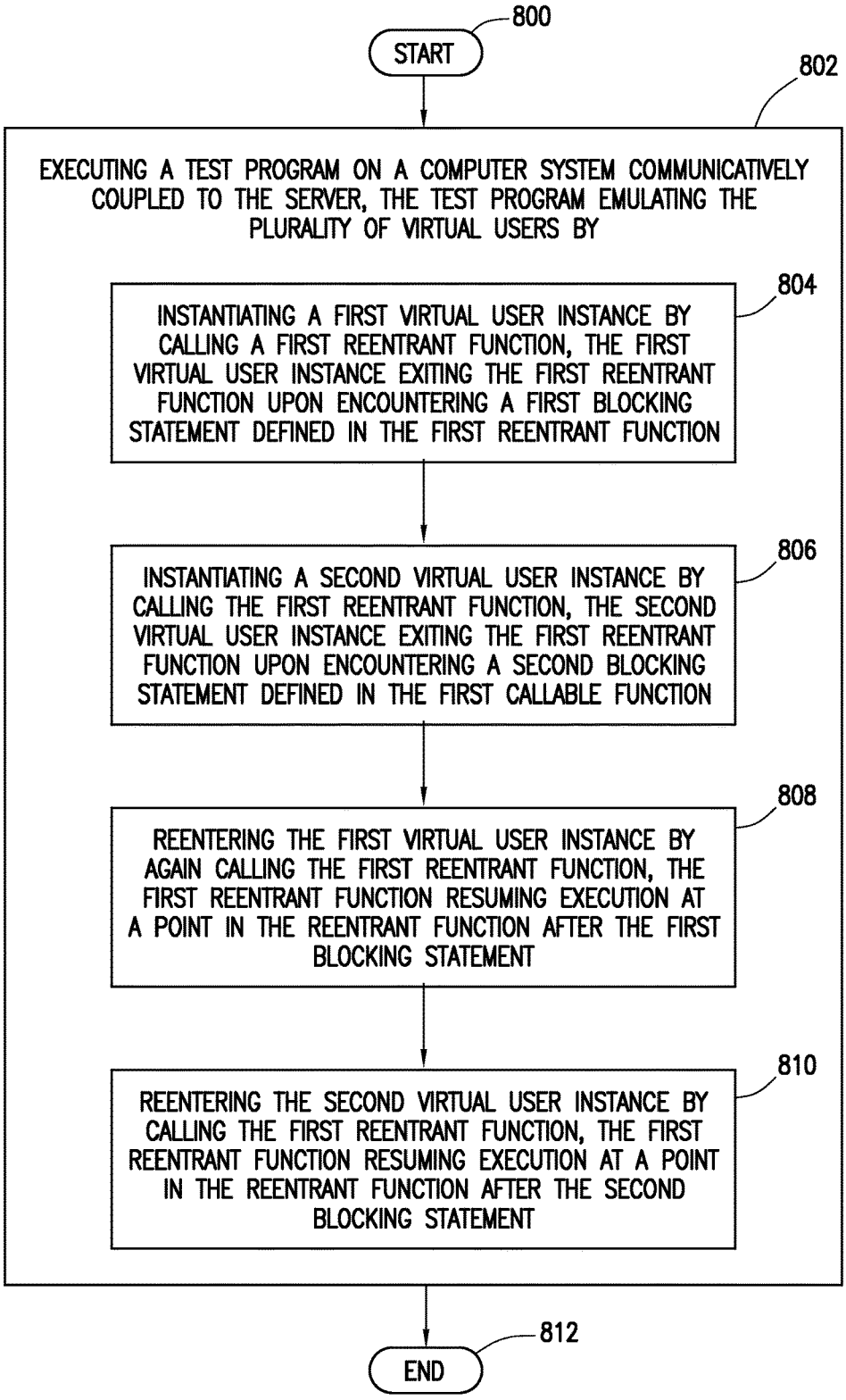
FIG. 8 shows, in flow diagram form, a method in accordance with at least one embodiment.

FIG. 8 shows a flow diagram depicting an overall method in accordance with at least one embodiment. The method starts (block 800) by executing a test program on a computer system, the computer system communicatively coupled to the server, the test program emulating the plurality of virtual users (block 802). The executing may comprise: instantiating a first virtual user instance by calling a first reentrant function, the first virtual user instance exiting the first reentrant function upon encountering a first blocking statement defined in the first reentrant function (block 804); instantiating a second virtual user instance by calling the first reentrant function, the second virtual user instance exiting the first reentrant function upon encountering a second blocking statement defined in the first callable function (block 806); reentering the first virtual user instance by again calling the first reentrant function, the first reentrant function resuming execution at a point in the reentrant function after the first blocking statement; (block 808); and reentering the second virtual user instance by calling the first reentrant function, the first reentrant function resuming execution at a point in the reentrant function after the second blocking statement (block 810). Thereafter, the method ends (block 812).

Figure 9:
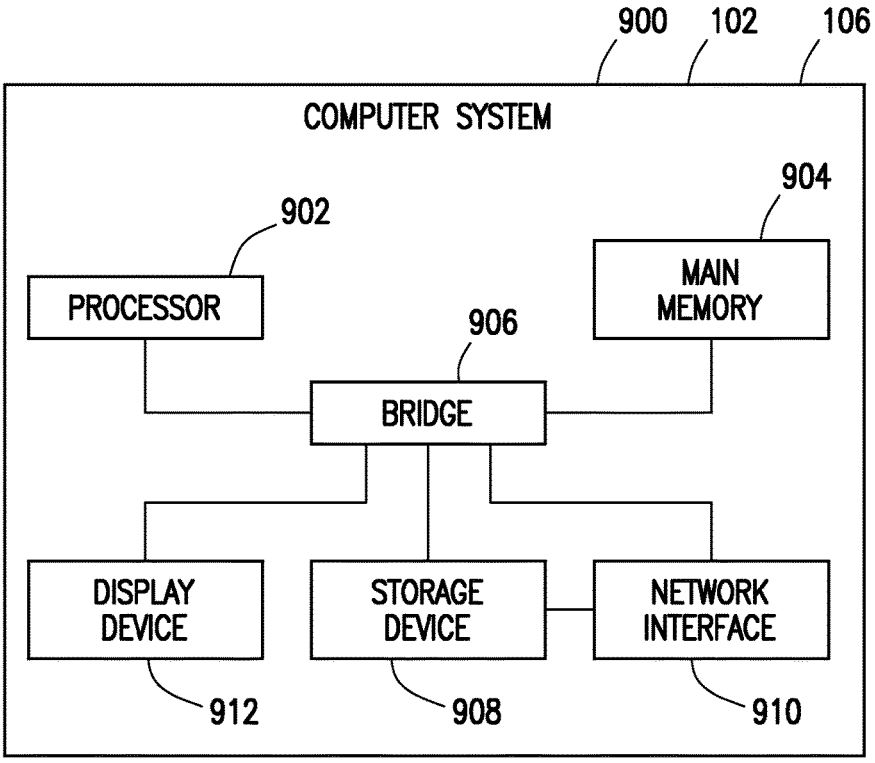
FIG. 9 shows an example computer system in accordance with at least some embodiments.

FIG. 9 shows a computer system 900, which is illustrative of a computer system upon which the various embodiments may be practiced. The computer system 900 may be illustrative of, for example, test computer system 106. In yet another embodiment, computer system 800 may be illustrative of server 102. In particular, computer system 900 comprises one or more processors 902, and the processor couples to a main memory 904 by way of a bridge device 906. Moreover, the processor 902 may couple to a long term storage device 908 (e.g., a hard drive, solid state disk, memory stick, optical disc) by way of the bridge device 906. Programs executable by the processor 902 may be stored on the storage device 908, and accessed when needed by the processor 902. For example, the program stored on the storage device 908 may comprise programs to translate the user input into an executable for and/or may comprise programs to emulate the multitudes of user instances. In some cases, the programs are copied from the storage device 908 to the main memory 904, and the programs are executed from the main memory 904. Thus, the main memory 904, and storage device 908 shall be considered computer-readable storage mediums. In addition, a display device 912 may be coupled to the processor 902 by way of bridge 906 which may comprise any suitable electronic display device upon which any image or text can be displayed. Furthermore, computer system 900 may comprise a network interface 910, coupled to the processor 902 by way of bridge 906, and coupled to storage device 908, the network interface acting to couple the computer system to a communication network, such as the Internet, or local- or wide-area networks.

From the description provided herein, those skilled in the art are readily able to combine software created as described with appropriate general-purpose or special-purpose computer hardware to create a computer system and/or computer sub-components in accordance with the various embodiments, to create a computer system and/or computer sub-components for carrying out the methods of the various embodiments and/or to create a non-transitory computer-readable medium (i.e., not a carrier wave) that stores a software program to implement the method aspects of the various embodiments.

References to "one embodiment," "an embodiment," "some embodiment," "various embodiments," or the like indicate that a particular element or characteristic is included in at least one embodiment of the invention. Although the phrases may appear in various places, the phrases do not necessarily refer to the same embodiment.

The above discussion is meant to be illustrative of the principles and various embodiments of the present invention. Numerous variations and modifications will become apparent to those skilled in the art once the above disclosure is fully appreciated. This context shall not be read as a limitation as to the scope of one or more of the embodiments described—the same techniques may be used for other embodiments. It is intended that the following claims be interpreted to embrace all such variations and modifications.

I claim:

1. A method of emulating a plurality of virtual users sending test messages to a server under test, the method comprising:

executing a test program on a computer system, the computer system communicatively coupled to the server, the test program emulating the plurality of virtual users by:

instantiating a first virtual user instance by calling a first reentrant function, including creating a first set of local variables in a first instance memory, the first virtual user instance executing, accessing at least one local variable in the first set of local variables, sending a first test message to the server, and exiting the first reentrant function upon encountering a first blocking statement defined in the first reentrant function; and instantiating a second virtual user instance by calling the first reentrant function, including creating a second set of local variables in a second instance memory, the second virtual user instance executing, accessing at least one local variable in the second set of local variables, sending a second test message to the server, and exiting the first reentrant function upon encountering a second blocking statement defined in the first reentrant function;

again calling the first reentrant function to reenter as the first virtual user instance and resuming execution at a point in the first reentrant function after the first blocking statement; and again calling the first reentrant function to reenter as the second virtual user instance and resuming execution at a point in the first reentrant function after the second blocking statement.

2. The method of claim 1 further comprising, prior to executing the test program:

receiving a first user input file containing an indication of a task to test on the server; and translating the first user input file into an executable version of the task, the executable version within the first reentrant function associated with the test program.

3. The method of claim 1 wherein instantiating the first virtual user instance further comprises:

allocating a memory area comprising the first instance memory associated with the first virtual user instance; and calling the first reentrant function and passing an indication of a location of the first instance memory.

4. The method of claim 3 wherein reentering the first virtual user instance further comprises:

receiving a first completion indication that a task associated with the first blocking statement has completed, the receiving by program steps implemented outside the first reentrant function;

determining that the first completion indication is associated with the first virtual user instance; and calling the first reentrant function and passing to the first reentrant function an indication of location of the first instance memory.

5. The method of claim 4:

wherein instantiating the first virtual user instance further comprises, prior to exiting the first reentrant function, writing a first resume indication in the first instance memory that indicates where execution should resume upon reentry; and wherein reentering the first virtual user instance further comprises reading, by the first reentrant function, the first resume indication; and resuming execution within the first reentrant function at the location indicated by the first resume indication.

6. The method of claim 4 wherein determining that the first completion indication is associated with the first virtual user instance further comprises reading, by program steps outside the first reentrant function, a third portion of the memory area that holds data that correlates the first completion indication to the first virtual user instance.

7. The method of claim 3 wherein instantiating the second virtual user instance further comprises:

allocating the memory area comprising the second instance memory associated with the second virtual user instance, the second instance memory distinct from the first instance memory; and calling the first reentrant function and passing an indication of location of the second instance memory.

8. The method of claim 7:

wherein reentering the first virtual user instance further comprises:

receiving a first completion indication that a task associated with the first blocking statement has completed, the receiving by program steps implemented outside the first reentrant function;

determining that the first completion indication is associated with the first virtual user instance; and calling the first reentrant function and passing to the first reentrant function an indication of location of the first instance memory;

wherein reentering the second virtual user instance further comprises:

receiving a second completion indication that a task associated with the second blocking statement has completed, the receiving by program steps implemented outside the first reentrant function;

determining that the second completion indication is associated with the second virtual user instance; and calling the first reentrant function and passing to the first reentrant function an indication of location of the second instance memory.

9. The method of claim 1 further comprising:

instantiating a third virtual user instance by calling a second reentrant function, the second reentrant function distinct from the first reentrant function, the third virtual user instance executing, accessing at least one local variable in a third set of local variables, and exiting the second reentrant function upon encountering a blocking statement defined in the second reentrant function; and again calling the second reentrant function to reenter as the third virtual user instance and resuming execution after the blocking statement defined in the second reentrant function.

10. The method of claim 1 wherein executing the test program emulating the plurality of virtual users further comprises emulating within a single processing thread.

11. The method of claim 10 wherein executing the test program emulating the plurality of virtual users further comprises emulating at least five thousand virtual users.

12. A computer system for emulating a plurality of virtual users sending test messages to a server under test comprising:

a processor;

a memory coupled to the processor; and a network interface coupled to the processor;

wherein the memory storing a program that, when executed by the processor, causes the processor to:

emulate a plurality of virtual users interacting with a remote server over the network interface, the emulation by causing the processor to:

instantiate a first virtual user instance by calling a first reentrant function, including creating a first set of local variables in a first instance memory, the first virtual user instance executing, accessing at least one local variable in the first set of local variables, sending a first test message to the server, and exiting the first reentrant function upon encountering a first blocking statement defined in the first reentrant function; and instantiate a second virtual user instance by calling the first reentrant function, including creating a second set of local variables in a second instance memory, the second virtual user instance executing, accessing at least one local variable in the second set of local variables, sending a second test message to the server, and exiting the first reentrant function upon encountering a second blocking statement defined in the first reentrant function;

again call the first reentrant function to reenter as the first virtual user instance and resume execution at a point in the first reentrant function after the first blocking statement; and again call the first reentrant function to reenter as the second virtual user instance and resume execution at a point in the first reentrant function after the second blocking statement.

13. The computer system of claim 12 wherein prior to when the processor emulates the plurality of virtual users, the program further causes the processor to:

receive a first user input file containing an indication of a task to test on the server; and translate the first user input file into an executable version of the first reentrant function.

14. The computer system of claim 12 wherein when the program instantiates the first virtual user instance, the program causes the processor to:

allocate a memory area comprising a first portion associated with the first virtual user instance; and call the first reentrant function and pass an indication of a location of the first portion of the memory area.

15. The computer system of claim 14 wherein when the program reenters the first virtual user instance, the program causes the processor to:

receive a first completion indication that a task associated with the first blocking statement has completed;

determine that the first completion indication is associated with the first virtual user instance; and call the first reentrant function and pass to the first reentrant function an indication of the location first portion of the memory area.

16. The computer system of claim 15:

wherein when the processor instantiates the first virtual user instance, the program causes the processor to, prior to exiting the first reentrant function, write a first resume indication in the first portion that indicates the memory of where execution should resume upon reentry; and wherein when the processor reenters the first virtual user instance, the program causes the processor to read the first resume indication; and resume execution within the first reentrant function at the location indicated by the first resume indication.

17. The computer system of claim 15 wherein when the processor determines that the first completion indication is associated with the first virtual user instance, the program causes the processor to read a third portion of the memory area that holds data that correlates the first completion indication to the first virtual user instance.

18. The computer system of claim 14 wherein when the processor instantiates the second virtual user instance, the program causes the processor to:

allocate the memory area comprising a second portion associated with the second virtual user instance, the second portion distinct from the first portion; and call the first reentrant function and pass an indication of the location of the second portion of the memory area.

19. The computer system of claim 18:

wherein when the processor reenters the first virtual user instance, the program causes the processor to:

receive a first completion indication that a task associated with the first blocking statement has complete;

determine that the first completion indication is associated with the first virtual user instance; and call the first reentrant function and pass to the first reentrant function an indication of the location first portion of the memory area;

wherein when the processor reenters the second virtual user instance, the program causes the processor to:

receive a second completion indication that a task associated with the second blocking statement has complete;

determine that the second completion indication is associated with the second virtual user instance; and call the first reentrant function and passing to the first reentrant function an indication of the location second portion of the memory area.

20. The computer system of claim 12 wherein the program further causes the processor to:

instantiate a third virtual user instance by a call to a second reentrant function, the second reentrant function distinct from the first reentrant function, the third virtual user instance executing, accessing at least one local variable in a third set of local variables, and exiting the second reentrant function upon encountering a blocking statement defined in the second reentrant function; and call the second reentrant function to reenter as the third virtual user instance and resume execution after the blocking statement defined in the second reentrant function.

21. The computer system of claim 12 wherein the program executes on a single thread of the processor.

22. The computer system of claim 21 wherein when the processor emulates, the program causes the processor to emulate at least five thousand virtual users.

23. A non-transitory computer-readable medium storing instructions for emulating a plurality of virtual users sending test messages to a server under test that, when executed by a processor, cause the processor to:

emulate a plurality of virtual users interacting with a remote server over a network interface, the emulation by causing the processor to instantiate a first virtual user instance by calling a first reentrant function, including creating a first set of local variables in a first instance memory, the first virtual user instance executing, accessing at least one local variable in the first set of local variables, sending a first test message to the server, and exiting the first reentrant function upon encountering a first blocking statement defined in the first reentrant function; and instantiate a second virtual user instance by calling the first reentrant function, including creating a second set of local variables in a second instance memory, the second virtual user instance executing, accessing at least one local variable in the second set of local variables, sending a second test message to the server, and exiting the first reentrant function upon encountering a second blocking statement defined in the first reentrant function;

again call the first reentrant function to reenter as the first virtual user instance and resume execution at a point in the first reentrant function after the first blocking statement; and again call the first reentrant function to reenter as the second virtual user instance and resume execution at a point in the first reentrant function after the second blocking statement.

24. The computer-readable medium of claim 23 wherein prior to when the processor emulates the plurality of virtual users, the program further causes the processor to:

receive a first user input file containing an indication of a task to test on the server; and translate the first user input file into an executable version of the first reentrant function.

25. The computer-readable medium of claim 23 wherein when the program instantiates the first virtual user instance, the program causes the processor to:

allocate a memory area comprising a first portion associated with the first virtual user instance; and call the first reentrant function and pass an indication of a location of the first portion of the memory area.

26. The computer-readable medium of claim 25 wherein when the program reenters the first virtual user instance, the program causes the processor to:

receive a first completion indication that a task associated with the first blocking statement has completed;

determine that the first completion indication is associated with the first virtual user instance; and call the first reentrant function and pass to the first reentrant function an indication of the location first portion of the memory area.

27. The computer-readable medium of claim 26:

wherein when the processor instantiates the first virtual user, the program causes the processor to, prior to exiting the first reentrant function, write a first resume indication in the first portion of the memory that indicates where execution should resume upon reentry; and wherein when the processor reenters the first virtual user instance, the program causes the processor to read the first resume indication; and resume execution within the first reentrant function at the location indicated by the first resume indication.

28. The computer-readable medium of claim 26 wherein when the processor determines that the first completion indication is associated with the first virtual user instance, the program causes the processor to read a third portion of the memory area that holds data that correlates the first completion indication to the first virtual user instance.

29. The computer-readable medium of claim 25 wherein when the processor instantiates the second virtual user instance, the program causes the processor to:

allocate the memory area comprising a second portion associated with the second virtual user instance, the second portion distinct from the first portion; and call the first reentrant function and pass an indication of the location of the second portion of the memory area.

30. The computer-readable medium of claim 29:

wherein when the processor reenters the first virtual user instance, the program causes the processor to:

receive a first completion indication that a task associated with the first blocking statement has complete;

determine that the first completion indication is associated with the first virtual user instance; and call the first reentrant function and pass to the first reentrant function an indication of the location first portion of the memory area and the first completion indication;

wherein when the processor reenters the second virtual user instance, the program causes the processor to:

receive a second completion indication that a task associated with the second blocking statement has complete;

determine that the second completion indication is associated with the second virtual user instance; and call the first reentrant function and passing to the first reentrant function an indication of the location second portion of the memory area.

31. The computer-readable medium of claim 23 wherein the program further causes the processor to:

instantiate a third virtual user instance by a call to a second reentrant function, the second reentrant function distinct from the first reentrant function, the third virtual user instance executing, accessing at least one local variable in a third set of local variables, and exiting the second reentrant function upon encountering a blocking statement defined in the second reentrant function; and call the second reentrant function to reenter as the third virtual user instance and resume execution after the blocking statement defined in the second reentrant function.

32. The computer-readable medium of claim 23 wherein the program executes on a single thread of the processor.

33. The computer-readable medium of claim 32 wherein when the processor emulates, the program causes the processor to emulate at least five thousand virtual users.

* * * * *